US010925449B2

(12) United States Patent
Lim et al.

(10) Patent No.: US 10,925,449 B2
(45) Date of Patent: Feb. 23, 2021

(54) CLEANER

(71) Applicant: Samsung Electronics Co., Ltd., Suwon-si (KR)

(72) Inventors: Jong Gook Lim, Suwon-si (KR); Jin Ho Lee, Suwon-si (KR); Kyong Hui Jeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 260 days.

(21) Appl. No.: 16/054,215

(22) Filed: Aug. 3, 2018

(65) Prior Publication Data

US 2018/0338657 A1 Nov. 29, 2018

Related U.S. Application Data

(62) Division of application No. 14/807,486, filed on Jul. 23, 2015, now Pat. No. 10,064,529.

(30) Foreign Application Priority Data

Jul. 31, 2014 (KR) ..... 10-2014-0098117

(51) Int. Cl.
*A47L 9/14* (2006.01)
*A47L 9/16* (2006.01)

(52) U.S. Cl.
CPC ..... *A47L 9/1427* (2013.01); *A47L 9/1691* (2013.01)

(58) Field of Classification Search
CPC ..... A47L 9/1427; A47L 9/1691; A47L 9/10; A47L 9/2857; A47L 5/36; A47L 9/009; A47L 5/28; A47L 9/1683; A47L 9/127; A47L 9/1666; A47L 9/1409; A47L 9/14; A47L 9/16
See application file for complete search history.

(56) References Cited

U.S. PATENT DOCUMENTS 7,159,273 B2 1/2007 Fawcett
2002/0108208 A1* 8/2002 Hamada ..... A47L 5/28 15/352
2014/0237767 A1* 8/2014 Conrad ..... A47L 9/1683 15/353

FOREIGN PATENT DOCUMENTS

EP 2049000 A1 4/2009

OTHER PUBLICATIONS

European Communication dated Feb. 22, 2018 in European Patent Application No. 15178928.6.
U.S. Restriction Requirement dated Jun. 12, 2017 in U.S. Appl. No. 14/807,486.

(Continued)

*Primary Examiner* — Robert J Scruggs
(74) *Attorney, Agent, or Firm* — Staas & Halsey LLP

(57) ABSTRACT

A cleaner includes a main body, a dust collection unit coupled with the main body at a part of the main body, and including a rotating shaft installing part, a connection member configured to connect the dust collection unit to the main body, and rotatably installed in the dust collection unit, an insertion part formed in the main body such that at least one part of the connection member is inserted into the insertion part, and a connection rotating shaft rotatably rested on the rotating shaft installing part such that the connection rotating shaft becomes a center of rotation of the connection member, the connection rotating shaft configured to move relatively along the rotating shaft installing part.

5 Claims, 14 Drawing Sheets

(56) References Cited

OTHER PUBLICATIONS

U.S. Office Action dated Sep. 1, 2017 in U.S. Appl. No. 14/807,486.
U.S. Office Action dated Feb. 20, 2018 in U.S. Appl. No. 14/807,486.
U.S. Notice of Allowance dated May 16, 2018 in U.S. Appl. No. 14/807,486.
U.S. Appl. No. 14/807,486, filed Jul. 23, 2015, Jong Gook Lim, et al., Samsung Electronics Co., Ltd.

* cited by examiner

CLEANER

CROSS-REFERENCE TO RELATED APPLICATIONS

This application is a Divisional Application of U.S. patent application Ser. No. 14/807,486, filed on Jul. 23, 2015, which claims the priority benefit of Korean Patent Application No. 10-2014-0098117, filed on Jul. 31, 2014 in the Korean Intellectual Property Office, the disclosures of which are incorporated herein by reference.

BACKGROUND

1. Field

Embodiments of the disclosure relate to a cleaner, and more particularly, to a cleaner including a connection unit to connect a dust collection unit to a main body.

2. Description of the Related Art

In general, a cleaner refers to equipment to suck air including dust on the floor, to collect the dust from the air, and then to discharge purified air.

The cleaner may be classified into a canister type in which a suction nozzle is separated from a main body and connected to the main body through a pipe, and an up-right type in which a main body and a suction nozzle are integrated into one body.

The cleaner may include a dust collection unit to separate dust from air and store the dust. The dust collection unit may be detachably coupled with the main body so that the dust collection unit may be coupled with the main body to collect dust, and detached from the main body to remove the collected dust.

Between the main body and the dust collection unit, a connection unit to connect the dust collection unit to the main body may be provided. Generally, the connection unit may be integrated with a button member, and move by an external force to couple the dust collection unit with the main body or decouple the dust collection unit from the main body.

The dust collection unit may include a dust collection unit gripping part to allow a user to grip the dust collection unit.

A user may apply an external force to the dust collection unit gripping part to release coupling of the dust collection unit with the main body to thereby decouple the dust collection unit from the main body. Also, the user may apply an external force to the dust collection unit gripping part to lift the dust collection unit and the main body from the floor while maintaining coupling of the dust collection unit with the main body.

If the button member is pressed when the main body and the dust collection unit are lifted from the floor, the dust collection unit may be decoupled from the main body. Since the dust collection unit gripping part is formed in the dust collection unit, the main body decoupled from the dust collection unit may fall to the floor. In this case, the user in a defenseless state may be damaged by the main body, or the main body may be damaged due to the impact with the floor.

SUMMARY

Therefore, it is an aspect of the disclosure to provide a cleaner for preventing coupling of a connection unit from being released when a main body and a dust collection unit are lifted from the floor.

Also, it is another aspect of the disclosure to provide a cleaner for preventing a dust collection unit from being detached from a main body by moving a rotating shaft of a connection unit, without adding another component.

Additional aspects of the disclosure will be set forth in part in the description which follows and, in part, will be apparent from the description, or may be learned by practice of the disclosure.

In accordance with an aspect of the disclosure, a cleaner may include: a main body, a dust collection unit coupled with the main body at a part of the main body, and including a rotating shaft installing part, a connection member configured to connect the dust collection unit to the main body, and rotatably installed in the dust collection unit, an insertion part formed in the main body such that at least one part of the connection member is inserted into the insertion part, and a connection rotating shaft rotatably rested on the rotating shaft installing part such that the connection rotating shaft becomes a center of rotation of the connection member, the connection rotating shaft configured to move relatively along the rotating shaft installing part.

The connection rotating shaft may be movable relatively between a first position and a second position in the rotating shaft installing part.

If the connection rotating shaft is located at the first position, the connection rotating shaft and the connection member may be rotatable at a predetermined angle, and if the connection rotating shaft is located at the second position, the connection rotating shaft and the connection member may be prevented from rotating.

The connection member may include a connection fixing rib protruding in a direction, and the dust collection unit may include a dust collection unit fixing rib disposed adjacent to the connection fixing rib.

If the connection rotating shaft is located at the first position, the connection fixing rib may be spaced apart from the dust collection unit fixing rib, and if the connection rotation shaft is located at the second position, the connection fixing rib may contact the dust collection unit fixing rib.

The rotating shaft installing part may be formed in the shape of a long hole such that the connection rotating shaft is movable along the rotating shaft installing part.

The rotating shaft installing part may be inclined with respect to a floor.

The cleaner may further include a connection elastic member configured to enable the connection rotating shaft moved relatively to the second position to elastically return to the first position.

The dust collection unit may include a button member configured to press a part of the connection member to rotate the connection member, and the button member may press the connection member at a third position to move to a fourth position.

The connection rotating shaft may be configured to be movable from a first position to a second position along the rotating shaft installing part, and if the connection rotating shaft is located at the second position, the button member may be fixed at the third position.

The button member and the connection member may be separate members.

The dust collection unit may include a button elastic member configured to enable the button member moved to the fourth position to elastically return to the third position.

The dust collection unit may include a dust collection unit gripping part configured to enable a user to grip the dust collection unit in order to separate the dust collection unit from the main body or to lift the main body and the dust collection unit from a floor.

If the main body and the dust collection unit are lifted from the floor by an external force applied to the dust collection unit gripping part, the connection rotating shaft may move relatively along the rotating shaft installing part.

The dust collection unit may include a button member provided at a part of the dust collection unit gripping part, and configured to be movable to rotate the connection member, and if the connection rotating shaft moves relatively along the rotation shaft installing part, the button member may be fixed.

In accordance with an aspect of the disclosure, a cleaner may include: a main body contacting a floor, a dust collection unit coupled with the main body at a part of the main body, a connection unit configured to connect the dust collection unit to the main body, and a button member configured to press a part of the connection unit to rotate the connection unit, in order to separate the dust collection unit from the main body, wherein if the main body is lifted from a floor, the connection unit is prevented from rotating even when the button member is pressed.

The connection unit may include a connection rotating shaft, and a connection member extending in a direction from the connection rotating shaft.

The connection rotating shaft may be installed in the dust collection unit, and the connection member may extend outside the dust collection unit such that at least one part of the connection member is inserted into the main body.

The dust collection unit may include a rotating shaft installing part on which the connection rotating shaft is rested, and the connection rotating shaft may be movable relatively in the rotating shaft installing part.

If the main body is lifted from the floor, the connection rotating shaft may move relatively in the rotating shaft installing part.

The button member and the connection unit may be separate members, and a part of the button member may contact a part of the connection unit.

In accordance with an aspect of the disclosure, a cleaner may include: a main body, a dust collection unit detachably coupled with the main body at a part of the main body, a connection unit configured to be movable between the main body and the dust collection unit in order to couple the dust collection unit with the main body and decouple the dust collection unit from the main body, and a dust collection unit fixing rib disposed adjacent to the connection unit in order to prevent the connection unit from rotating.

The connection unit may include a connection fixing rib corresponding to the dust collection unit fixing rib, and if the connection fixing rib contacts the dust collection unit fixing rib, the connection unit may be prevented from rotating.

The connection unit may include a connection rotating shaft that is a center of the connection unit, and the connection rotating shaft may be movable relatively between a first position and a second position inside the dust collection unit.

If the connection rotating shaft is located at the second position, the connection fixing rib may contact the dust collection unit fixing rib.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
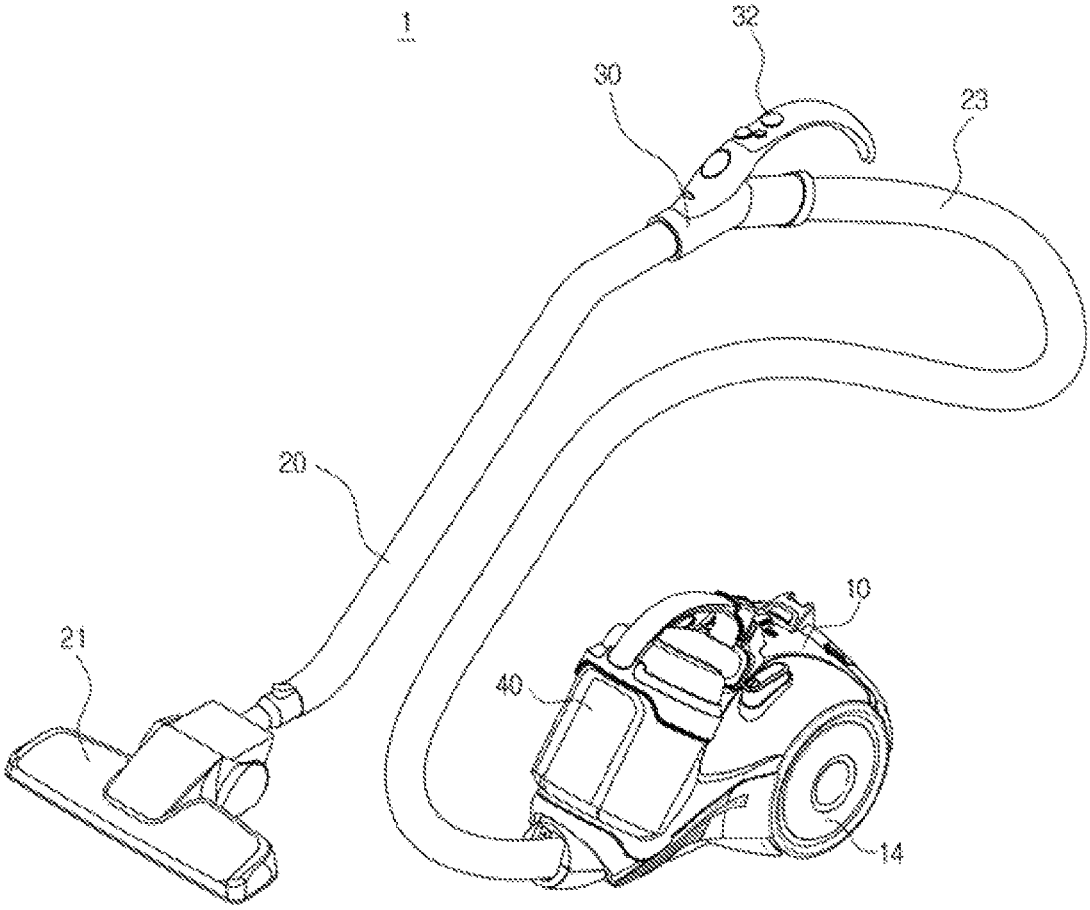
FIG. 1 is a perspective view showing a cleaner according to an embodiment of the disclosure.

Reference will now be made in detail to embodiments of the disclosure, examples of which are illustrated in the accompanying drawings, wherein like reference numerals refer to like elements throughout.

Figure 2:
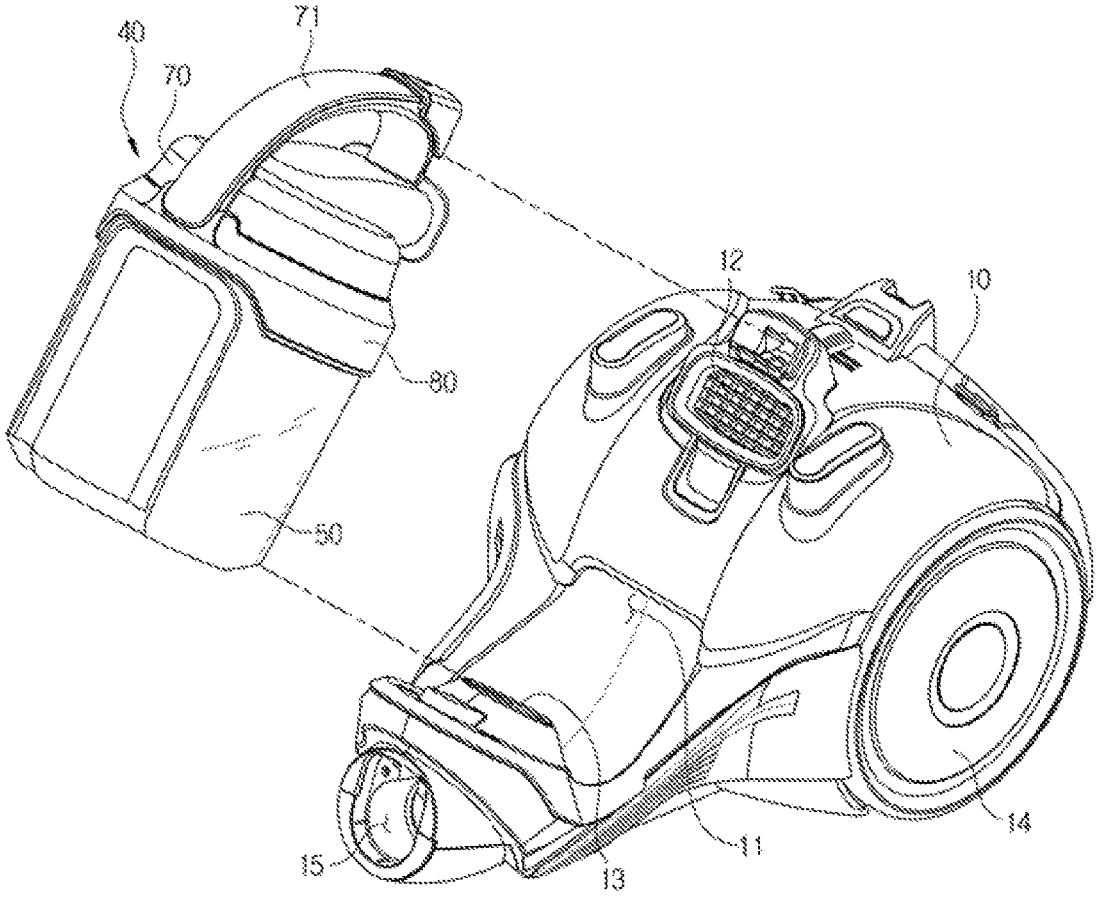
FIG. 2 shows a main body and a dust collection unit of a cleaner according to an embodiment of the disclosure.

FIG. 1 is a perspective view showing a cleaner 1 according to an embodiment of the disclosure, and FIG. 2 shows a main body 10 and a dust collection unit 40 of the cleaner 1 according to an embodiment of the disclosure.

Referring to FIGS. 1 and 2, the cleaner 1 may include the main body 10, and the dust collection unit 40 coupled with the main body 10 at a part of the main body 10. Also, the cleaner 1 may include a suction unit 21 contacting the floor and configured to suck air in.

The main body 10 may be rested on the floor. Also, the main body 10 may include a main body moving unit 14 coupled with a part of the main body 10 so that the main body 10 is movable on the floor. The main body moving unit 14 may be rotatable with respect to the main body 10, and a part of the main body moving unit 14 may contact the floor to support the main body 10 with respect to the floor.

Also, the main body 10 may include a fan motor (not shown) to generate a suction force. The suction unit 21 may suck air including dust from the floor using the suction force generated by the main body 10.

The suction unit 21 may be formed in a flat shape such that it may tightly contact the floor. Between the main body 10 and the suction unit 21, an extending pipe 20 and a flexible hose 23 may be provided. A handle pipe 30 for a user's manipulations may be positioned between the extending pipe 20 and the flexible hose 23. That is, the cleaner 1 according to an embodiment of the disclosure may be a canister type.

The suction unit 21, the extending pipe 20, the handle pipe 30, the flexible hose 23, and the main body 10 may be coupled to each other in this order. The extending pipe 20 may be fabricated with a resin or a metal material, and the flexible hose 23 may be fabricated with a flexible material for free movements of the handle pipe 30. At a part of the main body 10, a hose coupling part 15 with which the flexible hose 23 is coupled may be provided. The handle pipe 30 may include a manipulation unit 32 to allow a user to manipulate functions of the cleaner 1.

The suction unit 21, the extending pipe 20, the handle pipe 30, and the flexible hose 23 may communicate with each other. Accordingly, air sucked through the suction unit 21 may pass through the extending pipe 20, the handle pipe 30, and the flexible hose 23 sequentially to enter the main body 10. The main body 10 may include a suction port 13 to guide the sucked air to the dust collection unit 40, and an outlet port 12 to discharge purified air from the dust collection unit 40. The outlet port 12 may communicate with a fan motor chamber (not shown) having a fan motor (not shown) installed therein.

Also, the main body 10 may include a mounting part 11 on which the dust collection unit 40 may be rested. As shown in FIG. 2, the suction port 13 may be disposed below the mounting part 11, and the outlet port 12 may be disposed above the mounting part 11. The suction port 13 may protrude upward to enable the dust collection unit 40 to be stably rested on the mounting unit 11.

The dust collection unit 40 may be detachably rested on the mounting part 11. The dust collection unit 40 is used to collect dust from the air sucked through the suction unit 21 and to discharge purified air.

The dust collection unit 40 may include an inlet 42 (see FIG. 3) into which air including dust flows, and an outlet 72 (see FIG. 3) through which purified air is discharged. When the dust collection unit 40 is rested on the main body 10, the inlet 42 of the dust collection unit 40 may communicate with the suction port 13 of the main body 10, and the outlet 72 of the dust collection unit 40 may communicate with the outlet port 12 of the main body 10.

The dust collection unit 40 may have any structure capable of separating dust from air. Hereinafter, an embodiment of the dust collection unit 40 of separating dust from air through a centrifugal force will be described.

Figure 3:
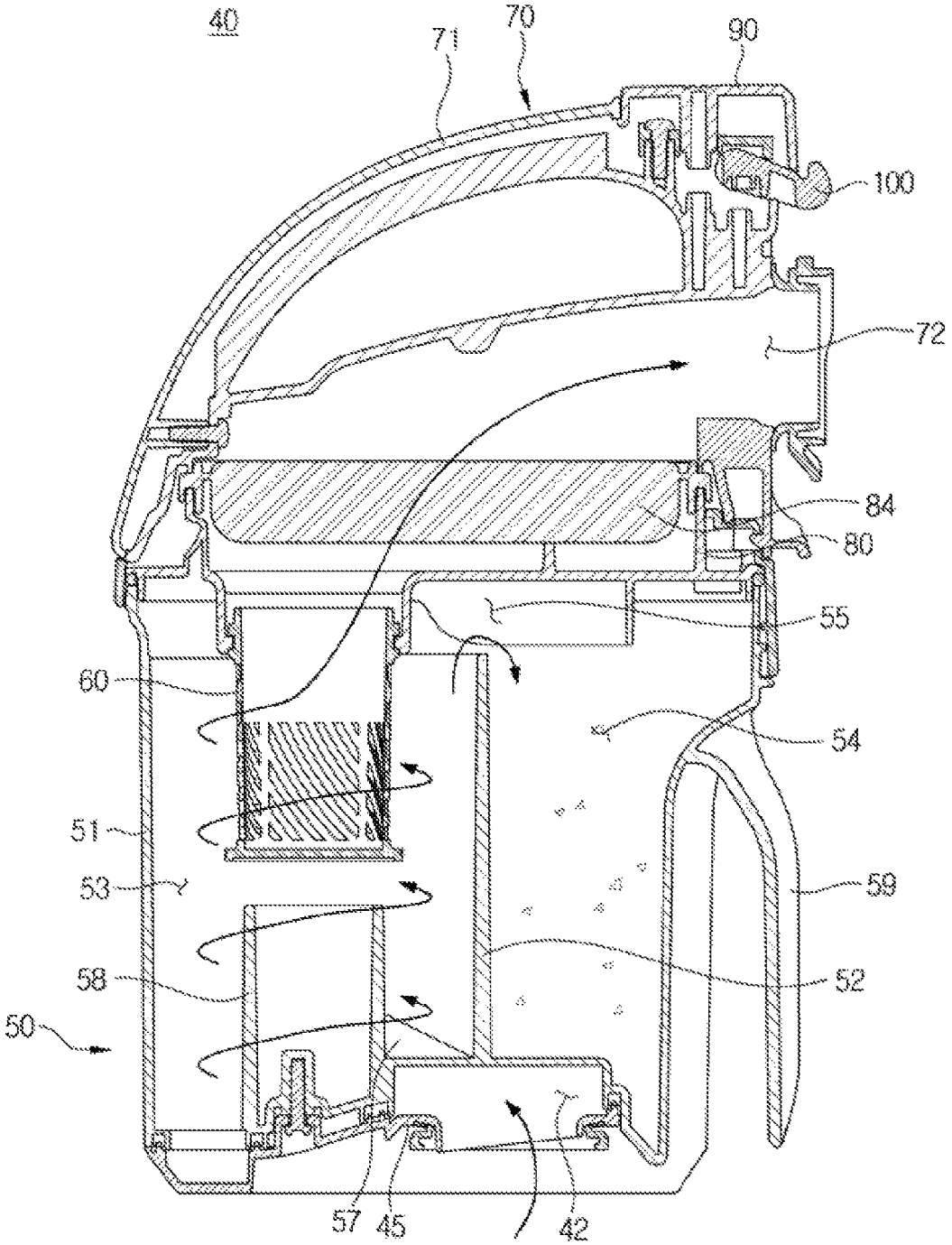
FIG. 3 is a view for describing the flow of air inside a dust collection unit of a cleaner according to an embodiment of the disclosure.
Figure 4:
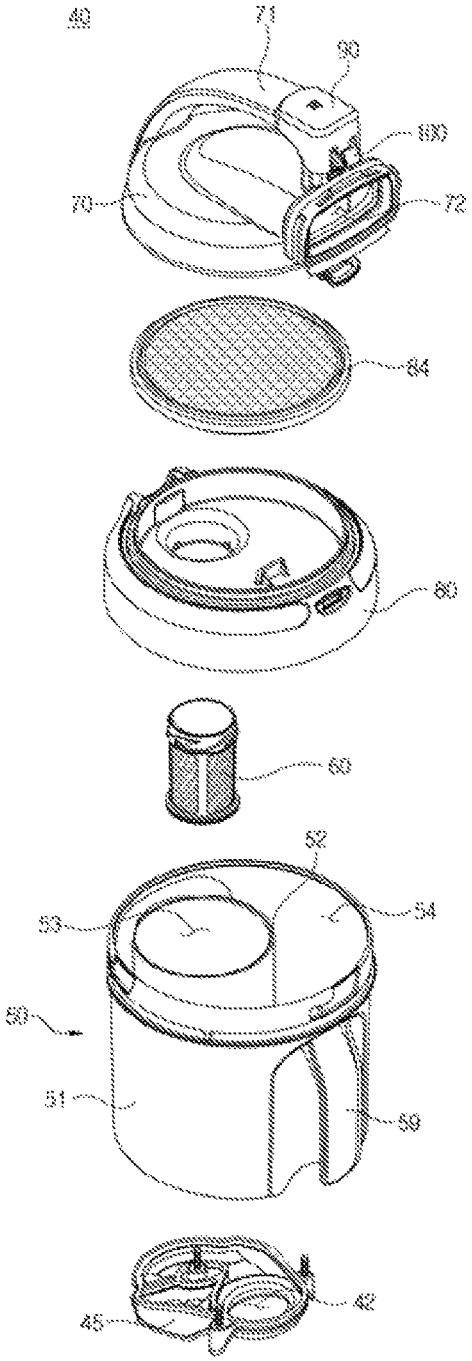
FIG. 4 is an exploded perspective view showing a dust collection unit of a cleaner according to an embodiment of the disclosure.

FIG. 3 is a view for describing the flow of air inside the dust collection unit 40 of the cleaner 1 according to an embodiment of the disclosure, and FIG. 4 is an exploded perspective view showing the dust collection unit 40 of the cleaner 1 according to an embodiment of the disclosure.

The dust collection unit 40 may include a cylindrical case 50, at least one of whose top and bottom is opened. Also, the dust collection unit 40 may include an upper cover 70, a middle cover 80, and a lower cover 45. However, the dust collection unit 40 may be fabricated as one body. Also, the case 50 may be formed in any other shape, instead of a cylindrical shape.

Each of the case 50, the upper cover 70, the middle cover 80, and the lower cover 45 may form a part of the external appearance of the dust collection unit 40. At least one of the case 50, the upper cover 70, the middle cover 80, and the lower cover 45 may be made of a transparent material so that dust stored in the dust collection unit 40 may be checked (i.e., visible) from the outside.

The upper cover 70 may be located at the top of the case 50 to cover the upper part of the case 60. The outlet 72 may be formed at a part of the upper cover 70. The upper cover 70 may include a dust collection unit gripping part 71 to allow a user to grip the dust collection unit 40. A user may apply an external force to the dust collection unit gripping part 71 to separate the dust collection unit 40 from the main body 10. Also, the user may apply an external force to the dust collection unit gripping part 71 to lift the main body 10 and the dust collection unit 40 coupled with the main body 10 from the floor.

The middle cover 80 may be positioned between the upper cover 70 and the case 50. The middle cover 80 may be detachably coupled with the top of the case 50 to cover the top of the case 50. The middle cover 80 may include a filter 84 that is installed in the inside of the middle cover 80.

The lower cover 45 may be coupled with the lower part of the case 50 to cover the opened bottom of the case 50. At a part of the lower cover 45, the inlet 42 may be formed. The lower cover 45 may be formed in a shape corresponding to the suction port 13 in order to be coupled with the suction port 13. That is, the lower cover 45 may be formed in a shape that is caved upward in correspondence to the suction port 13 protruding upward.

The case 50 may include an external wall 51 forming the external appearance of the case 50, and a case gripping part 59 formed at a part of the external wall 51. Also, the case 50 may include an internal wall 52 formed in the inside of the external wall 51. In the inside of the internal wall 52, a cyclone chamber 53 to separate dust from air may be formed, and between the internal wall 52 and the external wall 51, a dust collecting chamber 54 to collect dust may be formed. That is, the cyclone chamber 53 and the dust collecting chamber 54 may be sectioned by the internal wall 52.

The cyclone chamber 53 may generate a swirling air flow to separate dust from air by a centrifugal force. The cyclone chamber 53 may be formed in a cylindrical shape in order to generate the swirling air flow.

Inside the cyclone chamber 53, a guide unit 58 and a cyclone 60 may be provided. The guide unit 58 may be disposed at the center, lower part of the cyclone chamber 53, and the cyclone 60 may be disposed at the center, upper part of the cyclone chamber 53. As shown in FIG. 3, the guide unit 58 may be spaced a predetermined distance apart from the cyclone 60, and aligned with the cyclone 60.

Around the guide unit 58, a spiral part 57 may be formed in such a way to be inclined in a spiral shape. The guide unit 58 may be formed in a cylindrical shape to guide the air passing through the spiral part 57. Accordingly, the air may swirl around the guide unit 58 along the spiral part 57.

The cyclone 60 may discharge the air guided along the guide unit 58. The cyclone 60 may be formed in a cylindrical shape with a plurality of openings in order to pass the air therethrough.

In the upper part of the internal wall 52, an opening 55 may be formed. The opening 55 may enable the cyclone chamber 53 to communicate with the dust collecting chamber 54. Accordingly, dust separated from the air by the cyclone chamber 53 may move to the dust collecting chamber 54 through the opening 55.

Hereinafter, the flow of air inside the dust collection unit 20 will be briefly described with reference to FIG. 3. Air including dust may enter the dust collection unit 40 through the inlet 42 formed in the lower cover 45. The air including dust may enter the cyclone chamber 53 of the case 50 along the spiral part 57 connected to the inlet 42.

The air including dust that entered the cyclone chamber 53 may rise while swirling around the guide unit 58. Also, the air may continue to swirl along the cyclone 60 located above the guide unit 58.

Due to a centrifugal force generated by the swirling, the dust may move away from the center of rotation. The air may enter the cyclone 60 to pass through the filter 84, and then be discharged from the dust collection unit 40 through the outlet 72. The dust may rise over the internal wall 52, move to the dust collecting chamber 54 through the opening 55, and then be stored in the dust collecting chamber 54.

Figure 5:
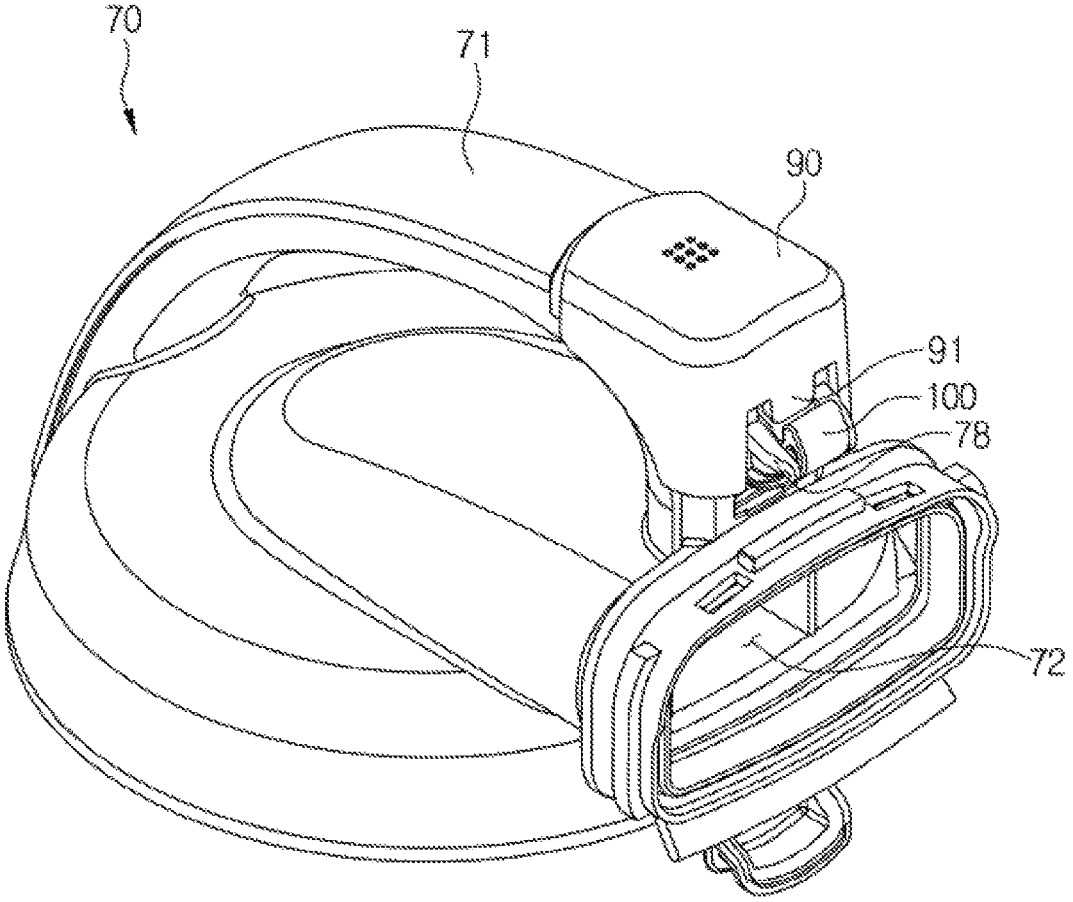
FIG. 5 is a perspective view showing a upper cover of a dust collection unit of a cleaner according to an embodiment of the disclosure.
Figure 6:
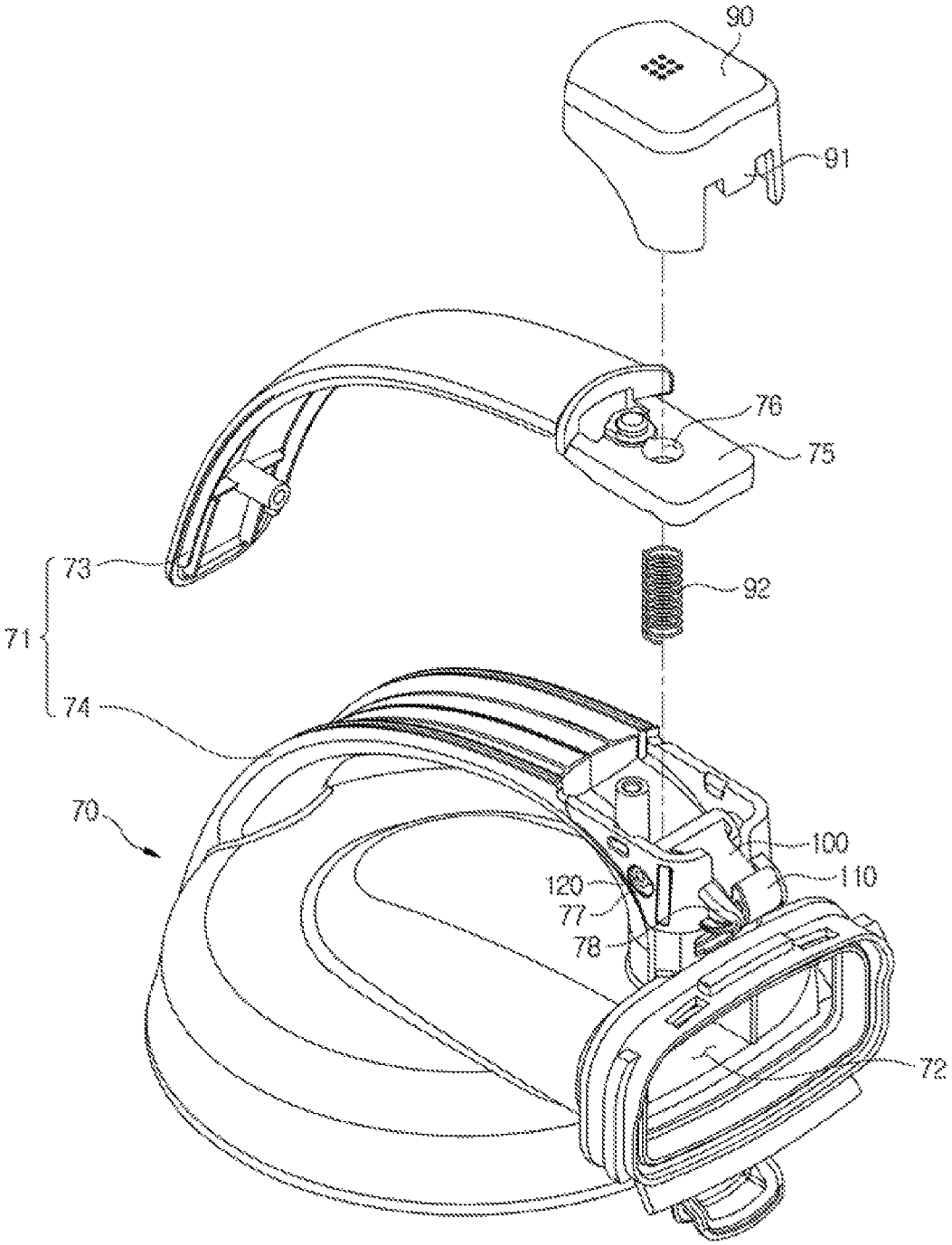
FIG. 6 is an exploded perspective view showing a dust collection unit gripping part of a cleaner according to an embodiment of the disclosure.

FIG. 5 is a perspective view showing the upper cover 70 of the dust collection unit 40 of the cleaner 1 according to an embodiment of the disclosure, and FIG. 6 is an exploded perspective view showing the dust collection unit gripping part 71 of the cleaner 1 according to an embodiment of the disclosure.

As described above, the dust collection unit 40 may be detachably coupled with the main body 10. In order to detachably couple the dust collection unit 40 with the main body 10, the cleaner 1 may include a connection unit 100 to connect the dust collection unit 40 to the main body 10. The connection unit 100 may be configured to fix the dust collection unit 40 at the main body 10 and to release the dust collection unit 40 from the main body 10.

When the connection unit 100 fixes the dust collection unit 40 at the main body 10, a user may stably clean the floor using the cleaner 1. Also, the user may apply an external force to the dust collection unit gripping part 71 to lift the main body 10 and the dust collection unit 40 from the floor to move them together. If the connection unit 100 releases the dust collection unit 40 from the main body 10, the user may detach the dust collection unit 40 from the main body 10 to remove dust collected in the dust collecting chamber 54.

The connection unit 100 may be installed at any one of the main body 10 and the dust collection unit 40. Hereinafter, an embodiment in which the connection unit 100 is installed at a part of the dust collection unit 40 will be described.

In order to fix the dust collection unit 40 at the main body 10 or to release the dust collection unit 40 from the main body 10, the connection unit 100 may be rotatably installed at the dust collection unit 40. The connection unit 100 may include a connection rotating shaft 120 that is the center of rotation, and a connection member 110 that rotates to be coupled with the main body 10.

The connection rotating shaft 120 may be rotatably installed at a part of the dust collection unit 40. The dust collection unit 40 may include a rotating shaft installing part 77 on which the connection rotating shaft 120 is rested. The main body 10 may include an insertion part 16 (see FIG. 9) into which at least one part of the connection member 110 is inserted. The insertion part 16 will be described in detail, later.

The dust collection unit 40 may include a button member 90 to rotate the connection unit 100. As shown in FIG. 6, the button member 90 and the connection unit 100 may be provided as separate members. The button member 90 may include a pressing part 91 to press a part of the connection member 110. The button member 90 may be disposed at a part of the dust collection unit gripping part 71.

The dust collection unit gripping part 71 may include a first gripping part 74 and a second gripping part 73. The first gripping part 74 may be integrated into the upper cover 70. The connection unit 100 may be rested on the first gripping part 74, and the first gripping part 74 may include a rotating shaft installing part 77 on which the connection rotating shaft 120 is rested.

The second gripping part 73 may be coupled with the upper part of the first gripping part 74. The first gripping part 74 may be coupled with the second gripping part 73 through a screw, etc. At a part of the second gripping part 73, a button coupling part 75 may be provided with which the button member 90 is coupled. The button coupling part 75 may include a button hole 76 into which the button member 90 fits.

The button member 90 may be rested on the upper part of the button coupling part 75 so that the button member 90 fits into the button hole 76, and the button member 90 may move to change a distance to the button coupling part 75. The dust collection unit 40 may include a button elastic member 92 to space the button member 90 moved close to the button coupling part 75 away from the button coupling part 75. That is, the button member 90 may be movable in an up and down direction with respect to the floor, and if no external force is applied by the button elastic member 92, the button member 90 may be maintained at its upper position.

The button member 90 may be rested on the button coupling part 75 such that the pressing part 91 faces a part of the connection unit 100. If an external force is applied to the button member 90, the pressing part 91 may move downward to press a part of the connection unit 100. Due to the pressure applied to the part of the connection unit 100 spaced from the connection rotating shaft 120, the connection unit 100 may rotate. If the external force applied to the button member 90 is removed, the button member 90 may rise by the button elastic member 92.

Figure 7:
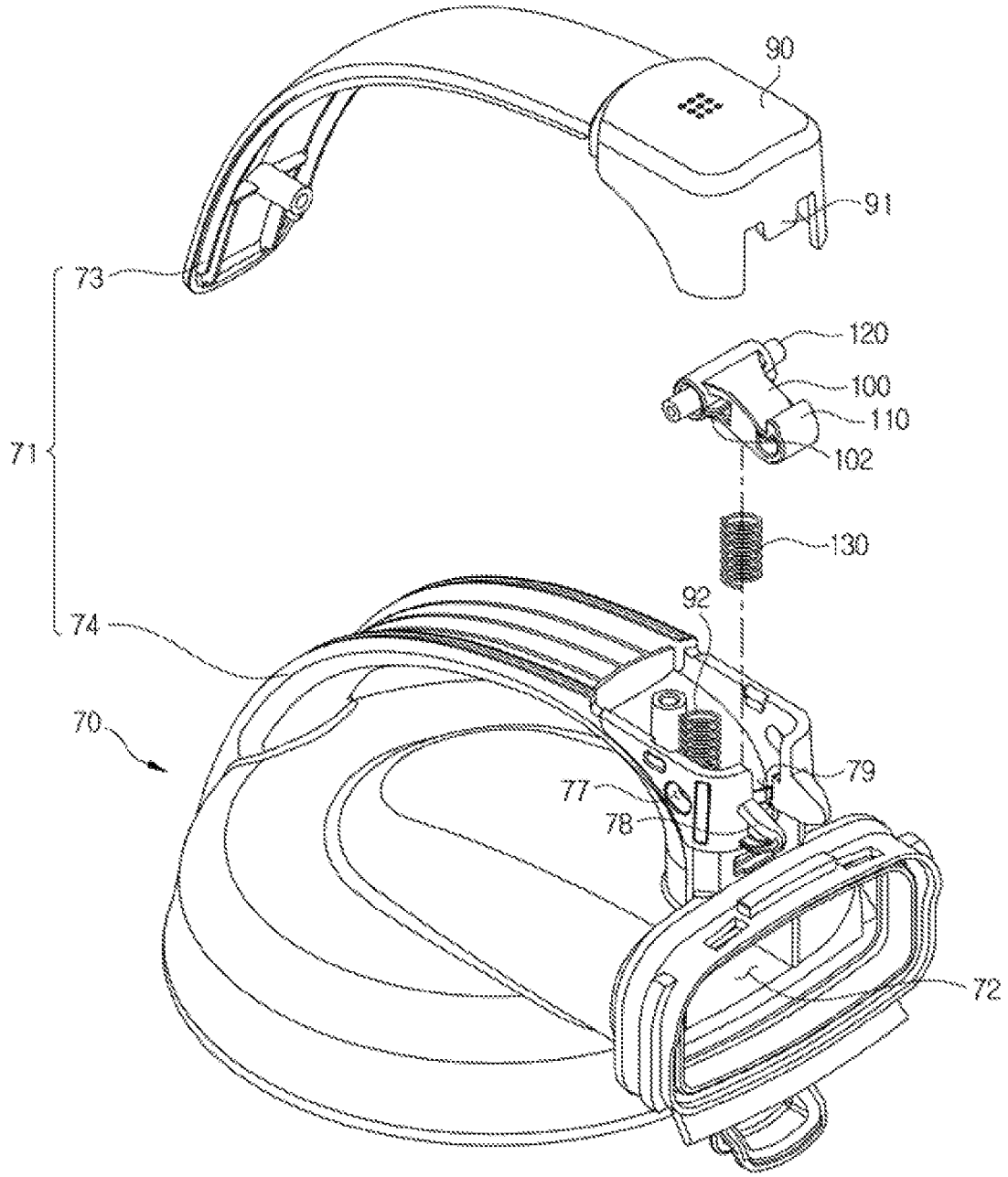
FIGS. 7 and 8 show a dust collection unit and a connection unit of a cleaner according to an embodiment of the disclosure.
Figure 8:
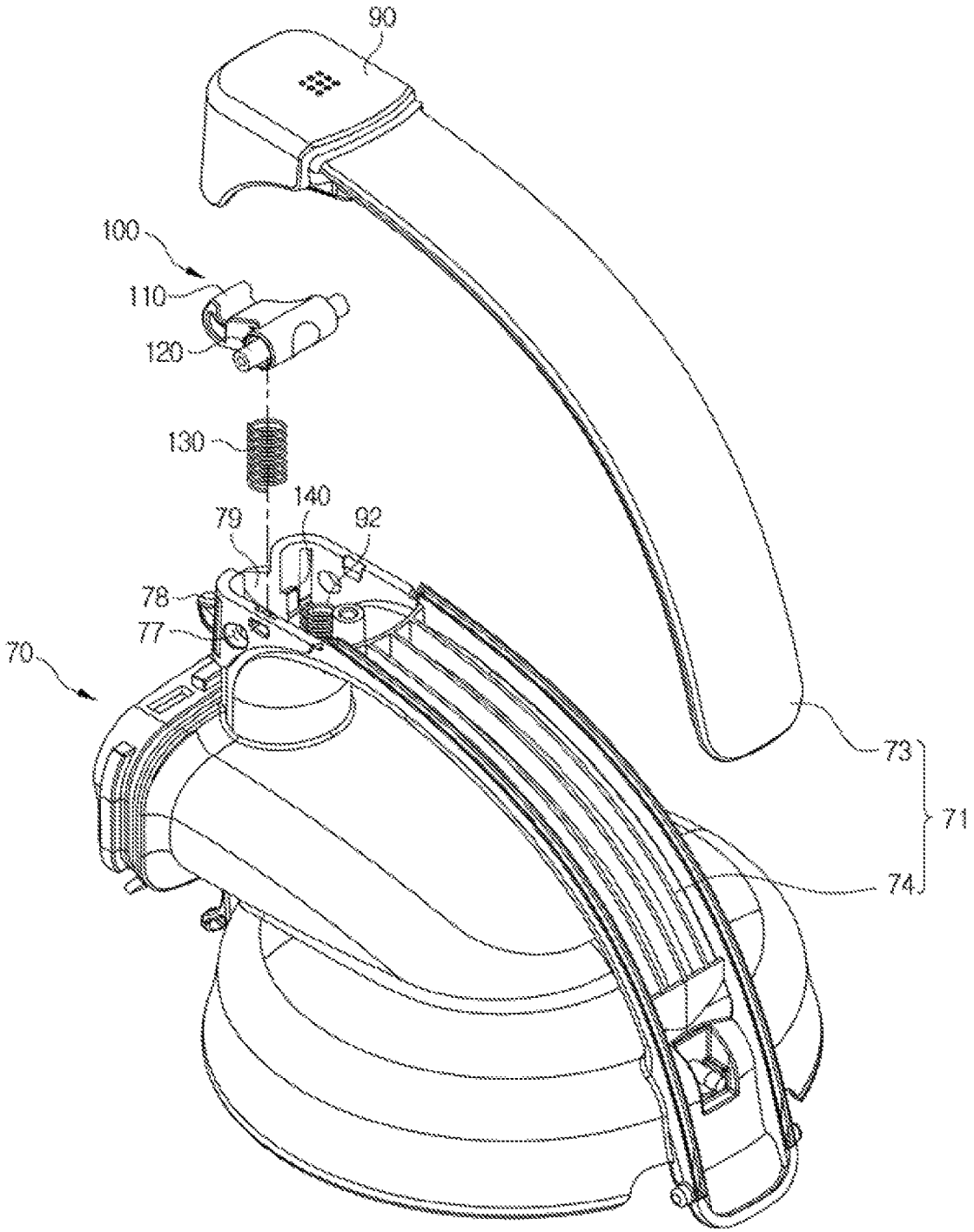

FIGS. 7 and 8 show the dust collection unit 40 and the connection unit 100 of the cleaner 1 according to an embodiment of the disclosure. FIG. 7 is a perspective view showing the dust collection unit 40 and the connection unit 100 in the direction in which the outlet 72 faces the front, and FIG. 8 is a perspective view showing the dust collection unit 40 and the connection unit 100 in the direction in which the outlet 72 faces the back.

As described above, the connection unit 100 may include the connection rotating shaft 120 and the connection member 110 extending in a direction from the connection rotating shaft 120. However, the connection unit 100 may be formed as one body. The connection unit 100 may be installed in the dust collection unit 40 such that the connection rotating shaft 120 is rested on the rotating shaft installing part 77.

The connection member 110 may extend outside the dust collection unit 40 such that at least one part of the connection member 110 may be inserted into the main body 10. The connection member 110 may be formed in the shape of a hook such that the connection member 110 may be coupled with the inserting part 16 to fix the dust collection unit 40 at the main body 10.

The dust collection unit 40 may include a connection installing opening 79 so that the connection member 110 may extend outward. A connection guide part 78 may be formed outward around the connection installing opening 79. The connection guide part 78 may guide the connection member 110 when the connection member 110 is inserted into the inserting part 16 of the main body 10. Also, the connection guide part 78 may support the main body 10 together with the connection member 110. The connection guide part 78 may be integrated into the dust collection unit 40.

The rotating shaft installing part 77 may be configured to accommodate the connection rotating shaft 120. The rotating shaft installing part 77 may be formed in the shape of a long hole extending in a direction (i.e., in the shape of a hole which is elongated in a direction). That is, the rotating shaft installing part 77 may extend longer than the diameter of the connection rotating shaft 120. Also, the rotating shaft installing part 77 may be inclined with respect to the floor. As shown in FIGS. 7 and 8, the rotating shaft installing part 77 may be inclined downward toward the connection installing opening 79.

Below the connection unit 100, the connection elastic member 130 may be installed. The connection elastic member 130 may enable the connection unit 100 moved by an external force to elastically return to its original position. If an external force applied to the button member 90 is removed after the connection unit 100 rotates by the button member 90, the connection unit 100 may return to its original position by the connection elastic member 130.

The connection rotating shaft 120 may move relatively along the rotating shaft installing part 77. As described above, the rotating shaft installing part 77 may extend longer than the diameter of the connection rotating shaft 120, and the connection rotating shaft 120 may move along the rotating shaft installing part 77.

If no external force is applied, the connection rotating shaft 120 may be positioned at the upper area of the rotating shaft installing part 77 by the connection elastic member 130. That is, the connection rotating shaft 120 may be positioned at the upper area of the rotating shaft installing part 77 far from the connection installing opening 79 (i.e., relatively farther away from the connection installing opening 79 than when the connection rotating shaft 120 is positioned at the lower area of the rotating shaft installing part 77). In this state, the connection rotating shaft 120 may be rotatable by an external force applied to the button member 90, and accordingly, the connection member 110 may be coupled with and decoupled from the insertion part 16. That is, the dust collection unit 40 may be coupled with and decoupled from the main body 10.

If an external force is applied so that the connection rotating shaft 120 moves relatively along the rotating shaft installing part 77, the connection rotating shaft 120 may be positioned at the lower area of the rotating shaft installing part 77. That is, the connection rotating shaft 120 may be positioned at the lower area of the rotating shaft installing part 77 adjacent to the connection installing opening 79 (i.e., relatively closer to the connection installing opening 79 than when the connection rotating shaft 120 is positioned at the upper area of the rotating shaft installing part 77). In this state, the connection rotating shaft 120 may not rotate by an external force applied to the button member 90, and accordingly, the connection member 110 may not be decoupled from the insertion part 16. That is, the dust collection unit 40 and the main body 10 may be maintained in a coupled state.

As shown in FIG. 7, in order to prevent the connection rotating shaft 120 from rotating, the connection unit 100 may include a connection fixing rib 102 that protrudes in a direction. As shown in FIG. 8, the dust collection unit 40 may include a dust collection unit fixing rib 140 disposed adjacent to the connection fixing rib 102.

If no external force is applied, the connection fixing rib 102 and the dust collection unit fixing rib 140 may be spaced apart from each other. If an external force is applied so that the connection rotating shaft 120 moves relatively along the rotating shaft installing part 77, the connection fixing rib 102 may contact the dust collection unit fixing rib 140. Accordingly, the connection unit 100 does not rotate due to the connection fixing rib 102 and the dust collection unit fixing rib 140.

Figure 9:
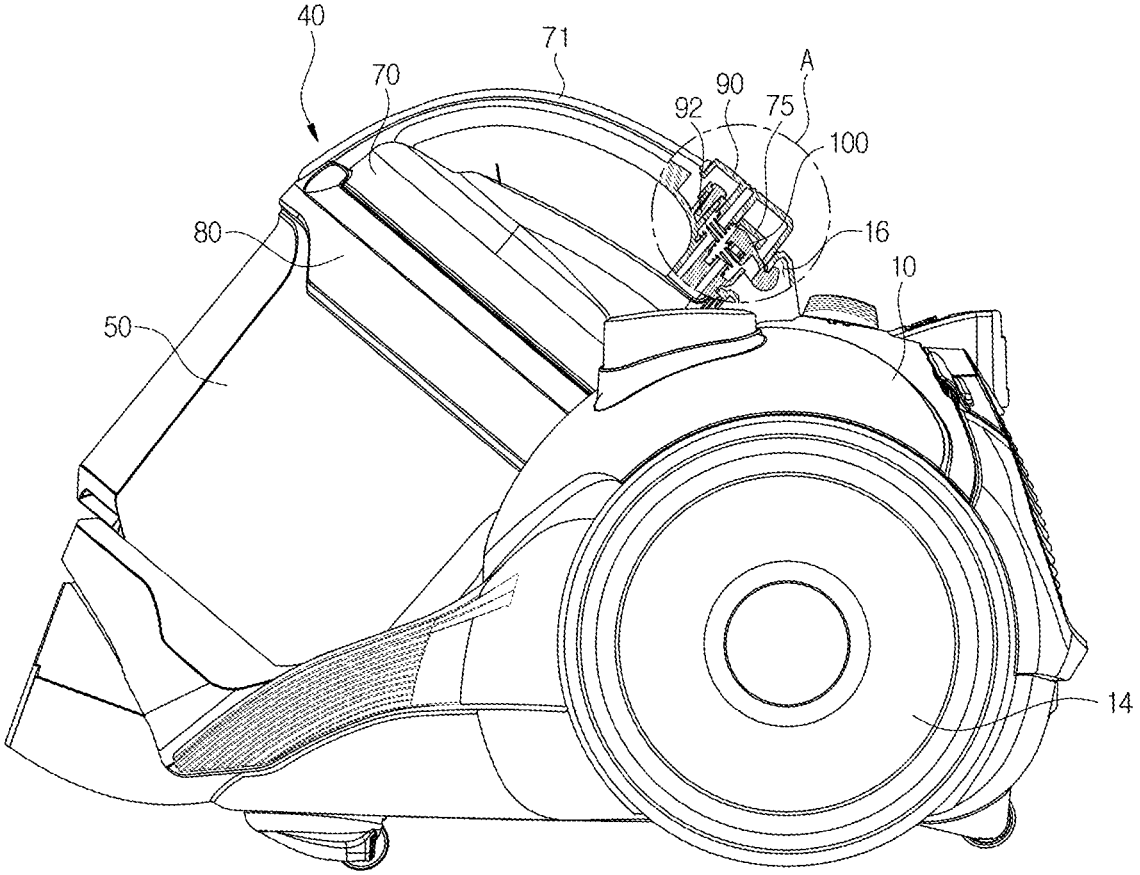
FIG. 9 is a partially cross-sectional view showing coupling of a dust collection unit and a main body of a cleaner according to an embodiment of the disclosure.
Figure 10:
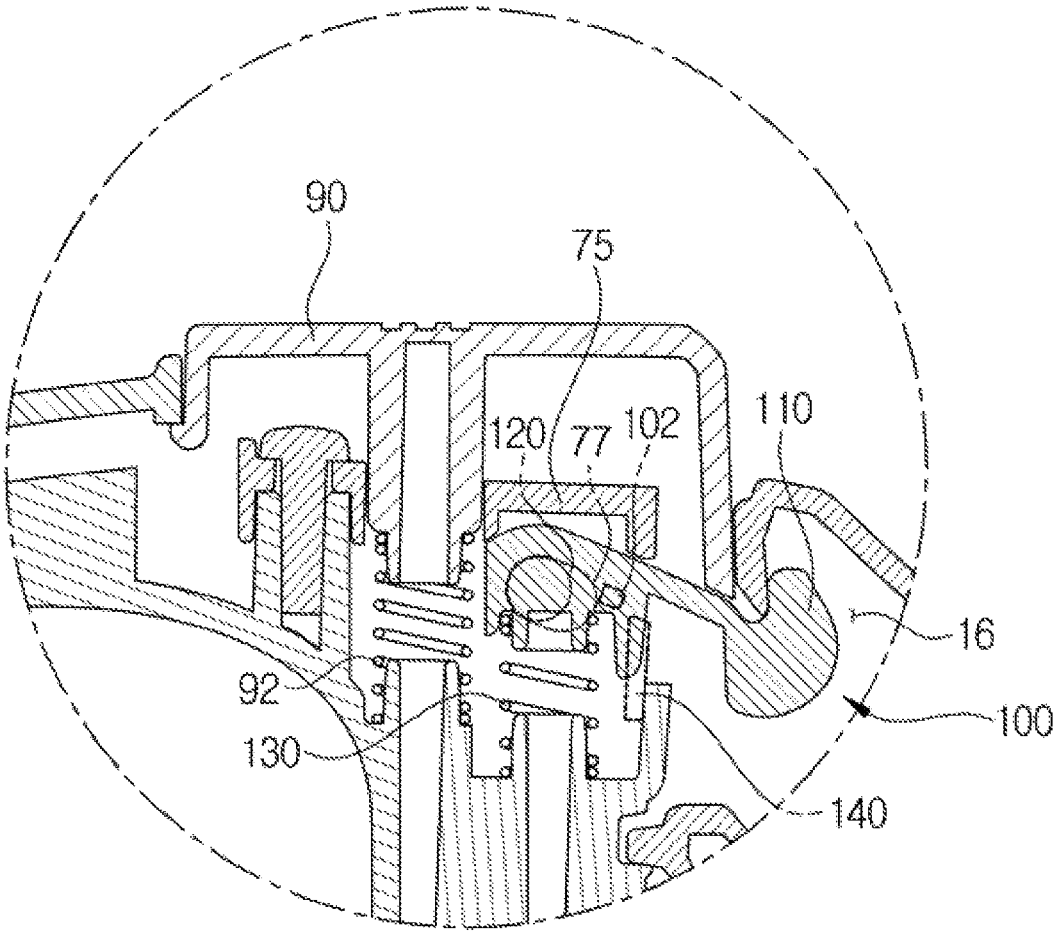
FIG. 10 is an enlarged view of an "A" area of FIG. 9.

FIG. 9 is a partially cross-sectional view showing coupling of the connection unit 100 and the main body 10 of the cleaner 1 according to an embodiment of the disclosure. In FIG. 9, in order to show coupling of the main body 10 with the connection unit 100 in detail, a part at which the main body 10 is coupled with the connection unit 100 is shown as a sectional view. FIG. 10 is an enlarged view of an "A" area of FIG. 9.

In FIGS. 9 and 10, a case in which the connection rotating shaft 120 is located at a first position, and the button member 90 is located at a third position is shown. When no external force is applied, the connection elastic member 130 may provide an elastic force to the connection rotating shaft 120 so that the connection rotating shaft 120 is located at the first position. Also, when no external force is applied, the button elastic member 92 may provide an elastic force to the button member 90 so that the button member 90 is located at the third position. That is, FIGS. 9 and 10 show the case in which no external force is applied. Herein, the external force refers to an external force that is applied to a part or body in some direction, for example, in the arrow directions shown in FIGS. 11 and 12.

The connection member 110 may be inserted into the insertion part 16. Although not shown in the drawings, the connection guide part 78 may also be inserted into the insertion part 16. Accordingly, the dust collection unit 40 may be coupled with the main body 10.

Figure 11:
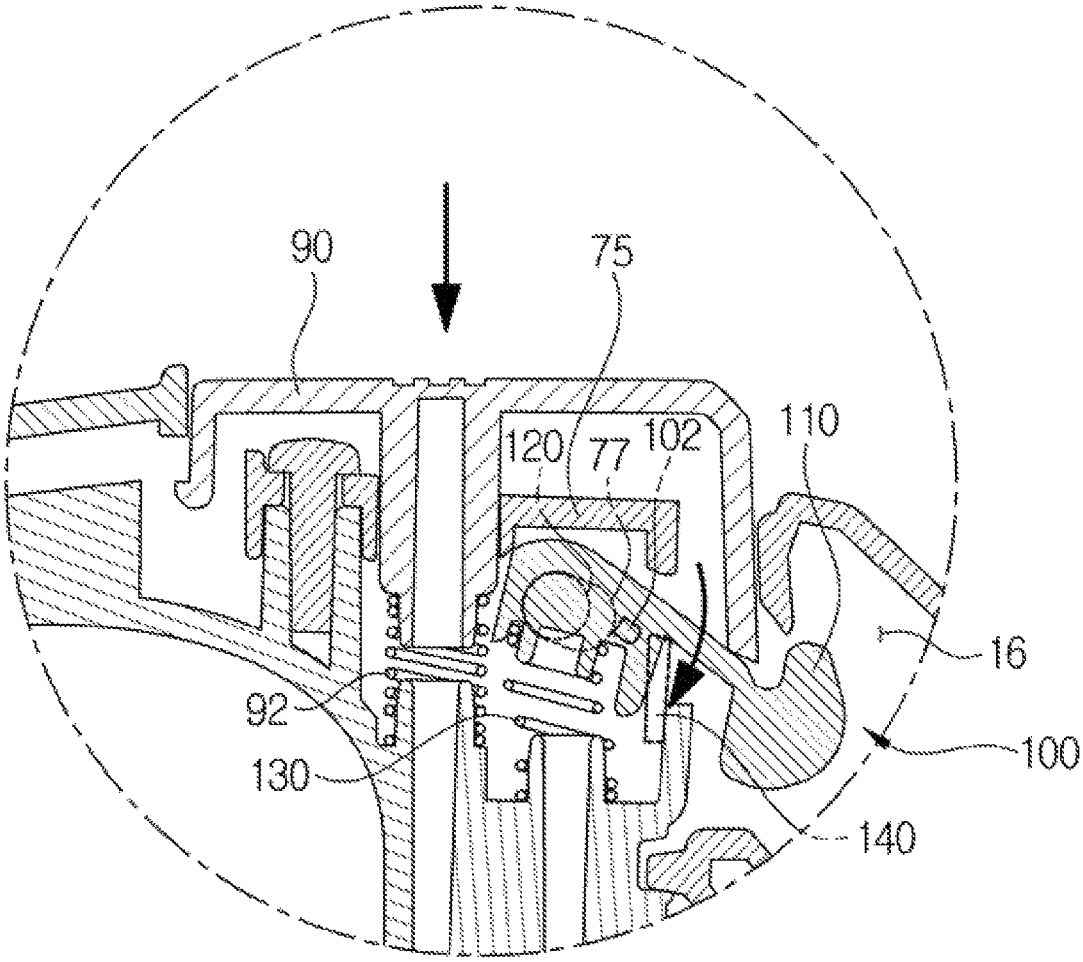
FIG. 11 shows a decoupled state of a connection unit when the connection unit rotates from a coupled state shown in FIG. 10.

FIG. 11 shows a decoupled state of the connection unit 100 when the connection unit 100 rotates from the coupled state shown in FIG. 10. In FIG. 11, the connection rotating shaft 120 may rotate at the first position, and the button member 90 may move from the third position to a fourth position.

Due to an external force applied to the button member 90 from the upper part, the button member 90 may move from the third position to the fourth position. If the button member 90 is lowered to press the connection unit 100, the connection member 110 may rotate with respect to the connection rotating shaft 120. Accordingly, the connection member 110 may be separated from the insertion part 16.

According to the lowering of the button member 90, the button elastic member 92 may be compressed, and according to the rotation of the connection member 110, the connection elastic member 130 may be deformed. If the external force applied to the button member 90 is removed, the button member 90 may return to the third position by the elastic force of the button elastic member 92. Also, the connection member 110 may return to its original position by the elastic force of the connection elastic member 130.

That is, if the connection rotating shaft 120 is located at the first position, the connection rotating shaft 120 and the connection member 110 may be rotatable at a predetermined angle. Accordingly, the connection member 110 may be coupled with and decoupled from the insertion part 16, so that the dust collection unit 40 may be coupled with and decoupled from the main body 10.

Also, when the connection rotating shaft 120 is located at the first position, the connection fixing rib 102 may be spaced apart from the dust collection unit fixing rib 140. Accordingly, the connection member 110 may rotate freely.

As a result, a user may press the button member 90 to thereby decouple the dust collection unit 40 from the main body 10. Since the button member 90 is disposed at a part of the dust collection unit gripping part 71, the user may press the button member 90 while gripping the dust collection unit gripping part 71.

Figure 12:
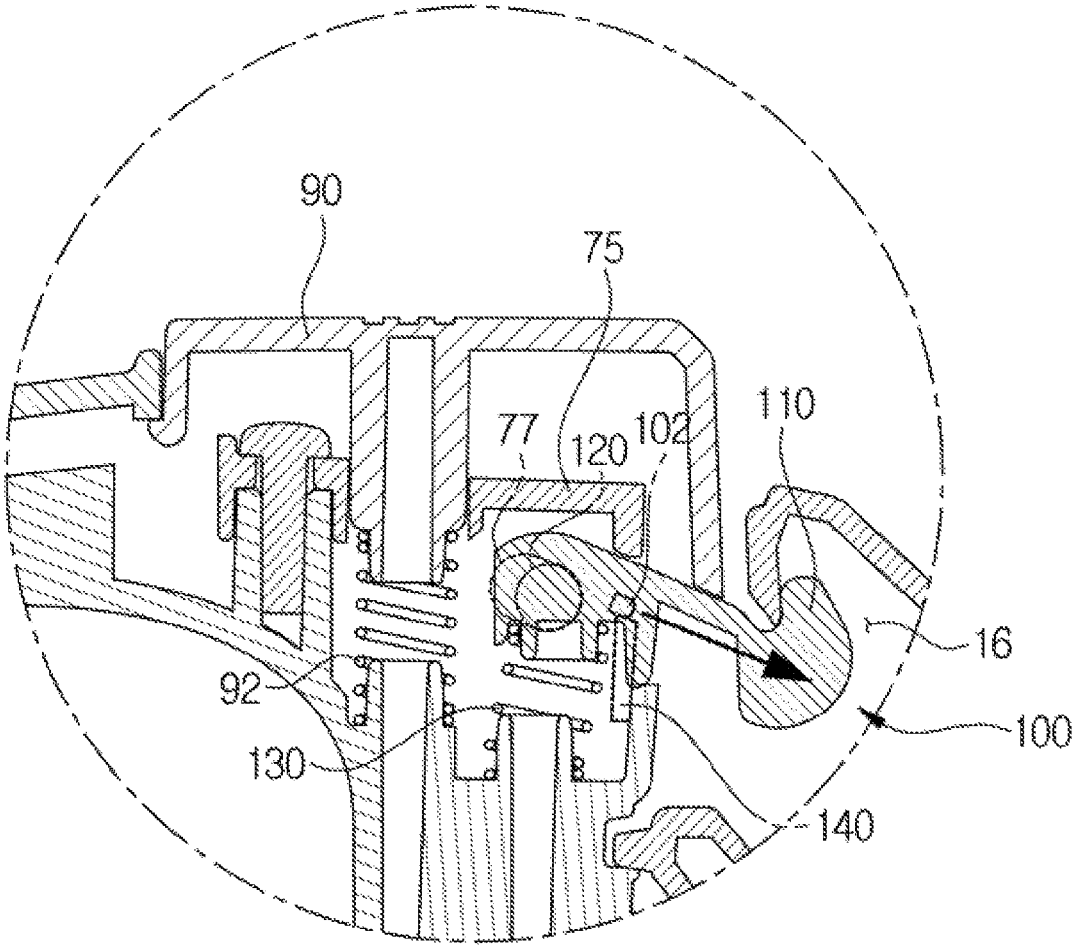
FIG. 12 shows a coupled state of the connection unit when the connection unit moves relatively from the coupled state shown in FIG. 10.

FIG. 12 shows a coupled state of the connection unit 100 when the connection unit 100 moves relatively from the coupled state shown in FIG. 10.

The user may grip the dust collection unit gripping part 71 to lift the dust collection unit 40 and the main body 10 from the floor to move them together. At this time, if the user presses the button member 90 so that the dust collection unit 40 is decoupled from the main body 10, an accident may occur. Accordingly, in order to avoid such an accident, the button member 90 may be configured to be fixed when a user grips the dust collection unit gripping part 71 to lift the dust collection unit 40 and the main body 10 from the floor.

When the user grips the dust collection unit gripping part 71 to lift the dust collection unit 40 and the main body 10 from the floor, the user may apply an external force upward from the floor. That is, an external force may be applied to the dust collection unit gripping part 71 in a direction that is opposite to the direction of gravity so that the main body 10 connected to the dust collection unit 40 by the connection unit 100 is lifted together with the dust collection unit 40 from the floor. Due to the external force, the connection rotating shaft 120 may move relatively to the second position.

When the connection rotating shaft 120 is located at the second position, the connection fixing rib 102 may contact the dust collection unit fixing rib 140. The connection fixing rib 102 and the dust collection unit fixing rib 140 may prevent the connection rotating shaft 120 and the connection member 110 from rotating.

Also, even when an external force is applied to the button member 90, the connection member 110 may not rotate due to the connection fixing rib 102 and the dust collection unit fixing rib 140. Accordingly, the button member 90 may be fixed at the third position, without moving to the fourth position. That is, the user cannot separate the dust collection unit 40 from the main body 10 by pressing the button member 90.

Figure 13:
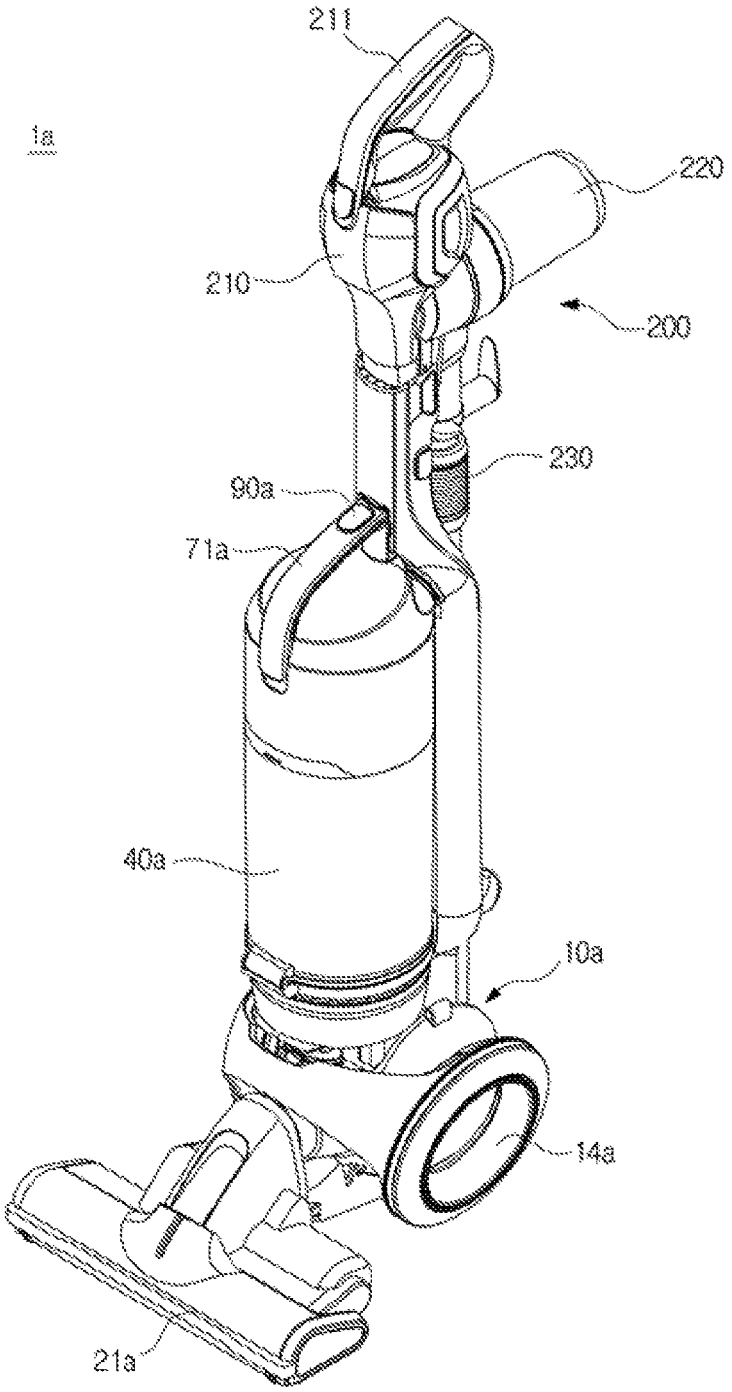
FIG. 13 is a perspective view showing a cleaner according to another embodiment of the disclosure.
Figure 14:
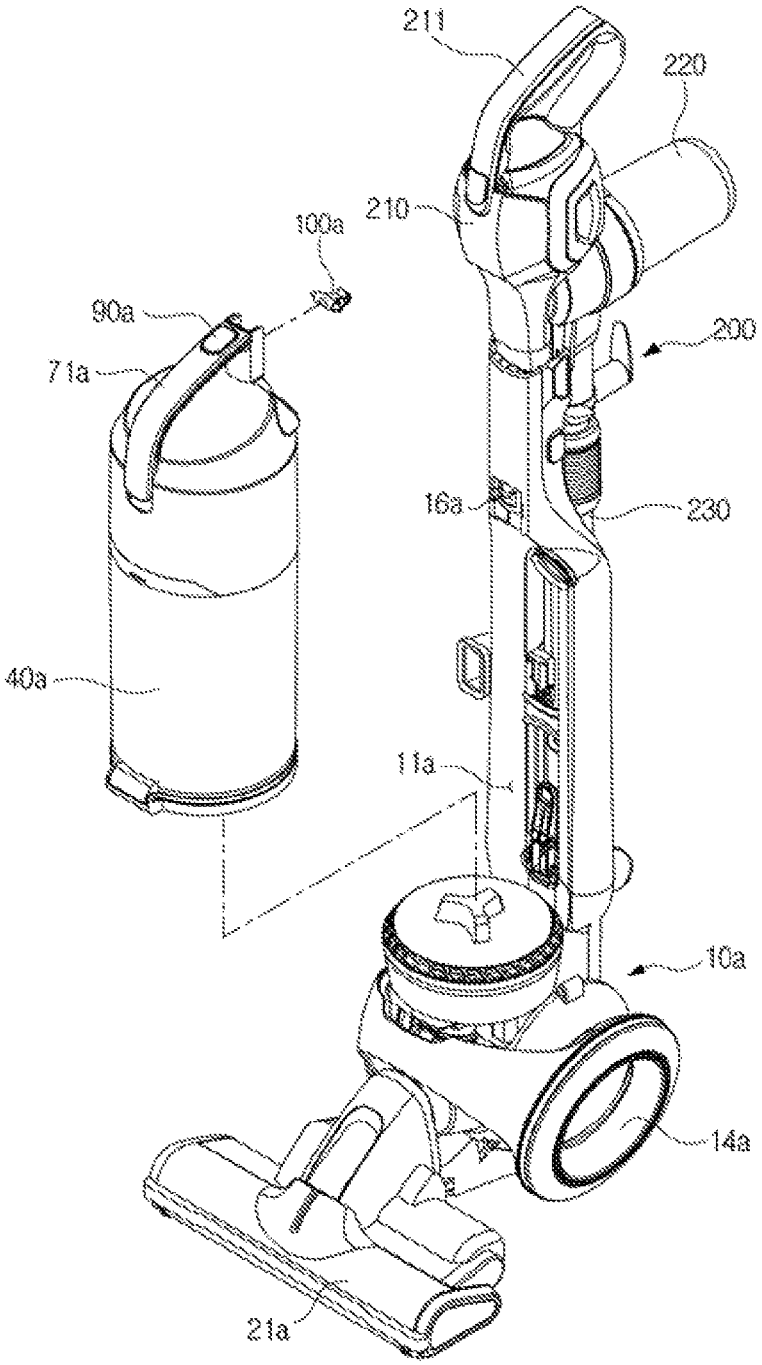
FIG. 14 shows a main body, a dust collection unit, and a connection unit of a cleaner according to an embodiment of the disclosure.

FIG. 13 is a perspective view showing a cleaner 1*a* according to another embodiment of the disclosure, and FIG. 14 shows a main body 10*a*, a dust collection unit 40*a*, and a connection unit 100*a* of the cleaner 1*a* according to another embodiment of the disclosure.

The cleaner 1*a* may include the main body 10*a*, and the dust collection unit 40*a* coupled with the main body 10*a* at a part of the main body 10*a*. Also, the cleaner 1*a* may include a suction unit 21*a* contacting the floor and configured to suck air. Also, the main body 10*a* may include a hand-held cleaning module 200 that enables a user to clean in a hand-held manner.

The main body 10*a* may include a main body moving unit 14*a* contacting the floor and configured to be movable on the floor. Also, the main body 10*a* may include a fan motor (not shown) to generate a suction force therein.

The suction unit 21*a* may suck air including dust on the floor by a suction force generated by the main body 10*a*. The suction unit 21*a* may be connected to the front part of the main body 10*a*. That is, the cleaner 1*a* may be an up-right type.

The main body 10*a* may include a mounting part 11*a* on which the dust collection unit 40*a* may be rested. The dust collection unit 40*a* may be detachably coupled with the mounting part 11*a*. The dust collection unit 40*a* may have any structure capable of separating dust from air.

The dust collection unit 40*a* may include a dust collection unit gripping part 71*a* to enable a user to grip the dust collection unit 40, and a button member 90*a* provided at a part of the dust collection unit gripping part 71. A user may apply an external force to the button member 90*a* to separate the dust collection unit 40*a* from the main body 10*a*. Also, the user may apply an external force to lift the main body 10*a* coupled with the dust collection unit 40*a* from the floor.

Also, the cleaner 1*a* may include a connection unit 100*a* to connect the dust collection unit 40*a* to the main body 10*a*. The connection unit 100*a* may be configured to couple the dust collection unit 40*a* with the main body 10*a* and decouple the dust collection unit 40*a* from the main body 10*a*. Accordingly, if the connection unit 100*a* fixes the dust collection unit 40*a* at the main body 10*a*, the user may apply an external force to the dust collection unit gripping part 71*a* to lift the main body 10*a* and the dust collection unit 40*a* from the floor to move them together.

The connection unit 100*a* may be installed in the dust collection unit 40*a*, and the main body 10*a* may include an insertion part 16*a* into which at least one part of the connection unit 100*a* is inserted. Detailed descriptions about the same components of the connection unit 100*a* as those of the connection unit 100 will be omitted since they have been described above with reference to FIGS. 5 to 12. That is, aspects of the dust collection unit 40, connection unit 100, dust collection unit gripping part 71, button member 90, and insertion part 16, and components thereof, as described above with reference to FIGS. 5 to 12, may be applied to the dust collection unit 40*a*, connection unit 100*a*, dust collection unit gripping part 71*a*, button member 90*a*, and insertion part 16*a*, and components thereof shown in FIGS. 13 and 14.

The hand-held cleaning module 200 may be detachably coupled with the main body 10*a*. The hand-held cleaning module 200 may include a hand-held main body 210, and a hand-held dust collection unit 220 that is detachably coupled with the hand-held main body 210 to collect foreign materials. Also, the hand-held cleaning module 200 may include an extending pipe 230 having a predetermined length to enable a user to clean a target at a distance from a target.

The hand-held main body 210 may include a hand-held fan motor (not shown) to generate a suction force when the hand-held cleaning module 200 performs cleaning in a hand-held manner. At a part of the hand-held main body 210, a handle part 211 that a user may grip may be provided.

According to embodiments of the disclosure as described above, by preventing the connection unit from rotating when the dust collection unit and the main body are lifted from the floor, it is possible to prevent the dust collection unit from being detached from the main body when the dust collection unit and the main body are lifted from the floor.

Also, the rotating shaft of the connection unit connecting the dust collection unit to the main body may move automatically by an external force applied to the dust collection unit gripping part.

Although embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A cleaner, comprising:

a main body;

a dust collector coupled with a part of the main body;

a connector configured to connect the dust collector to the main body, and including a rotating shaft installing part, a connection rotating shaft provided in the rotating shaft installing part, and a connection latch extending from the connection rotating shaft; and a button configured to press a part of the connector to rotate the connector to separate the dust collector from the main body, wherein the connection rotating shaft is configured to move in the rotating shaft installing part to move a center of rotation of the connection rotating shaft relative to the rotating shaft installing part from a first position to a second position when the dust collector coupled with the main body is lifted from a surface, and wherein the dust collector and connector are configured so that the connection rotating shaft is moved to the second position so that the connector is prevented from rotating when the button is pressed while the main body is lifted from the surface.

2. The cleaner according to claim 1, wherein the connection latch is configured to rotate on the connection rotating shaft.

3. The cleaner according to claim 2, wherein the connection rotating shaft is installed in the dust collector, and the connection latch extends outside the dust collector and at least a part of the connection latch is insertable into the main body.

4. A cleaner, comprising:

a main body;

a dust collector detachably coupled with a part of the main body;

a connector configured to be movable to couple the dust collector with the main body and to decouple the dust collector from the main body, wherein the connector includes a rotation shaft support and a rotation shaft provided in the rotation shaft support, and wherein the rotation shaft is configured to move relative to the rotation shaft support to move a center of rotation of the rotation shaft from a first position to a second position in the rotation shaft support when the dust collector coupled with the main body is lifted from a surface; and a dust collector fixing rib disposed adjacent to the connector to contact the connector to prevent the connector from rotating when the connector is in the second position.

5. The cleaner according to claim 4, wherein the connector comprises a connection fixing rib corresponding to the dust collector fixing rib, and when the connection fixing rib contacts the dust collector fixing rib in the second position, the connector is prevented from rotating.

* * * * *